US008128390B2

(12) United States Patent
O'Hara

(10) Patent No.: US 8,128,390 B2
(45) Date of Patent: Mar. 6, 2012

(54) PORTABLE CONCRETE MOULDING MACHINE

(75) Inventor: Fergus O'Hara, Queensland (AU)

(73) Assignee: Edgetec Group Pty Ltd., Summer Park (AU)

( * ) Notice: Subject to any disclaimer, the term of this patent is extended or adjusted under 35 U.S.C. 154(b) by 947 days.

(21) Appl. No.: 12/114,015

(22) Filed: May 2, 2008

(65) Prior Publication Data

US 2008/0274220 A1 Nov. 6, 2008

(30) Foreign Application Priority Data

May 3, 2007 (AU) ..... 2007100358

(51) Int. Cl.
*B29C 31/04* (2006.01)

(52) U.S. Cl. ..... 425/63; 425/64; 404/98

(58) Field of Classification Search ..... 425/63, 425/64; 404/98
See application file for complete search history.

(56) References Cited

U.S. PATENT DOCUMENTS 3,507,015 A 4/1970 Heatlie
(Continued)

FOREIGN PATENT DOCUMENTS

AU B-56437/80 4/1983
AU A-81 150/82 9/1983
(Continued)

*Primary Examiner* — Joseph Del Sole
*Assistant Examiner* — James Sanders
(74) *Attorney, Agent, or Firm* — Allen, Dyer, Doppelt, Milbarth & Gilchrist, P.A.

(57) ABSTRACT

A portable concrete molding machine can extrude concrete moldings of a range of widths by the provision of one or more tunnel plates within the mold, the machine being provided with respective pusher plates that have pusher faces of widths complementary to the effective widths of the mold. A pair of links connect a gearbox to the pendulum arms of the pusher means to ensure even driving force applied to the pusher plates as they undergo reciprocating movement to allow concrete to flow from a hopper through a mouth of the mold and to extrude the concrete from the mold, the machine being advanced in an extrusion direction by the extrusion of the concrete from the mold.

6 Claims, 5 Drawing Sheets

U.S. PATENT DOCUMENTS

| | | | | | |
|---|---|---|---|---|---|
| 4,566,823 | A | * | 1/1986 | May | 404/98 |
| 4,936,763 | A | | 6/1990 | Thomas | |
| 5,051,025 | A | | 9/1991 | Taylor, Jr. | |
| 5,527,129 | A | * | 6/1996 | McKinnon | 404/98 |

FOREIGN PATENT DOCUMENTS

| | | | |
|---|---|---|---|
| AU | 620031 | | 2/1992 |
| BR | 1203436 | | 8/1970 |
| WO | WO 95/16078 | | 6/1995 |
| WO | WO 9636467 | A1 * | 11/1996 |

* cited by examiner

PORTABLE CONCRETE MOULDING MACHINE

CROSS-REFERENCE TO RELATED APPLICATION

This application claims priority to Australian application 2007100358, filed May 3, 2007.

BACKGROUND OF THE INVENTION

1. Field of the Invention

The present invention is directed to a portable concrete molding machine, and, in particular, to a machine for the molding of continuous concrete moldings or extrusions, such as garden edges, road edges, parking bay edges, dividers, and the like.

2. Related Art

The concrete molding machine disclosed in AU-B-16008188 (620031) (Edgetec Group Pty Ltd) has found considerable commercial success under the EDGEMASTER® trademark. The success of this machine has led to a number of inferior imitations entering the market.

One limitation with the EDGEMASTER® machine has been a maximum molding width of, e.g., 175-200 mm.

Another limitation has been the difficulty in adjusting the machine to mold concrete to different widths.

SUMMARY OF THE INVENTION

The present invention provides a concrete molding machine that can mold articles of greater width than existing molding machines, wherein the width of the concrete extruded can be quickly and easily changed, and that has an improved drive mechanism.

In one aspect, the present invention includes a concrete molding machine of the type having a mold through which concrete is extruded, the machine being movable in an extrusion direction. The machine comprises a hopper for concrete connected to an entrance of the mold and a pusher means for forcing concrete through the mold. The pusher means includes a pusher plate with a pusher face that extends substantially across the width of the mold.

Support means are provided for the pusher plate to enable reciprocating movement of the pusher plate between a first position allowing concrete to pass from the hopper to the mold and a second position extruding concrete from the mold. A drive mechanism is connected to the pusher means to generate the reciprocating movement of the pusher plate. At least one tunnel plate is detachably mountable within the mold to reduce the width of the mold, and the pusher plate has at least one mounting means releasably mounted on mounting supports on the pusher means. The pusher plate is detachable from the pusher means and can be substituted by a second pusher plate with a pusher face that extends substantially across the reduced width of the mold.

Preferably, a pair of tunnel plates are detachably mountable to respective side plates of the mold. Also preferably, a respective pusher plate is provided for each effective reduction in the width of the mold effected by the tunnel plate(s). Further, the pusher means preferably has a top plate formed integrally with the pusher plate, the top plate having at least two sockets detachably engageable on complementary carrier arms on the support means, or vice versa.

In a second aspect, the present invention comprises a concrete molding machine of the type having a mold through which concrete is extruded, the machine being movable in an extrusion direction. The machine includes a hopper for concrete connected to an entrance of the mold and a pusher means for forcing concrete through the mold. The pusher means includes a pusher plate with a pusher face that extends substantially across a width of the mold.

Support means for the pusher plate enables reciprocating movement of the pusher plate between a first position allowing concrete to pass from the hopper to the mold and a second position extruding concrete from a mold. A drive mechanism is connected to the pusher means to generate the reciprocating movement of the pusher plate. The support means includes a pair of pendulum arms pivotally mounted on the hopper or a frame member for the machine, wherein the pendulum arms are optionally interconnected by a cross-member adjacent the pusher means, and both pendulum arms are operably connected to the drive mechanism.

Preferably, the drive mechanism has a gearbox driven by a power source, the gearbox having a pair of output shafts connected by respective driving links to the pendulum arms distal from the hopper or frame member. Also preferably, each driving link is adjustable in length, to enable adjustment of the reciprocating movement of the pusher plate. The driving links are also preferably connected to the output shafts by respective crank throws fixed to the output shafts.

The power source may be an internal combustion engine, electric motor, hydraulic motor, or pneumatic motor or the like.

The gearbox may be directly coupled to the power source, or be connected by, e.g., a belt-and-pulley or sprocket-and-chain drive.

BRIEF DESCRIPTION OF THE DRAWINGS

To enable the invention to be fully understood, preferred embodiments will now be described with reference to the accompanying drawings.

DETAILED DESCRIPTION OF THE PREFERRED EMBODIMENTS

The portable concrete molding machine 10 of the present invention is generally similar to the layout of the portable concrete molding machine disclosed in AU-B-16008/88 (620031).

Figure 1:
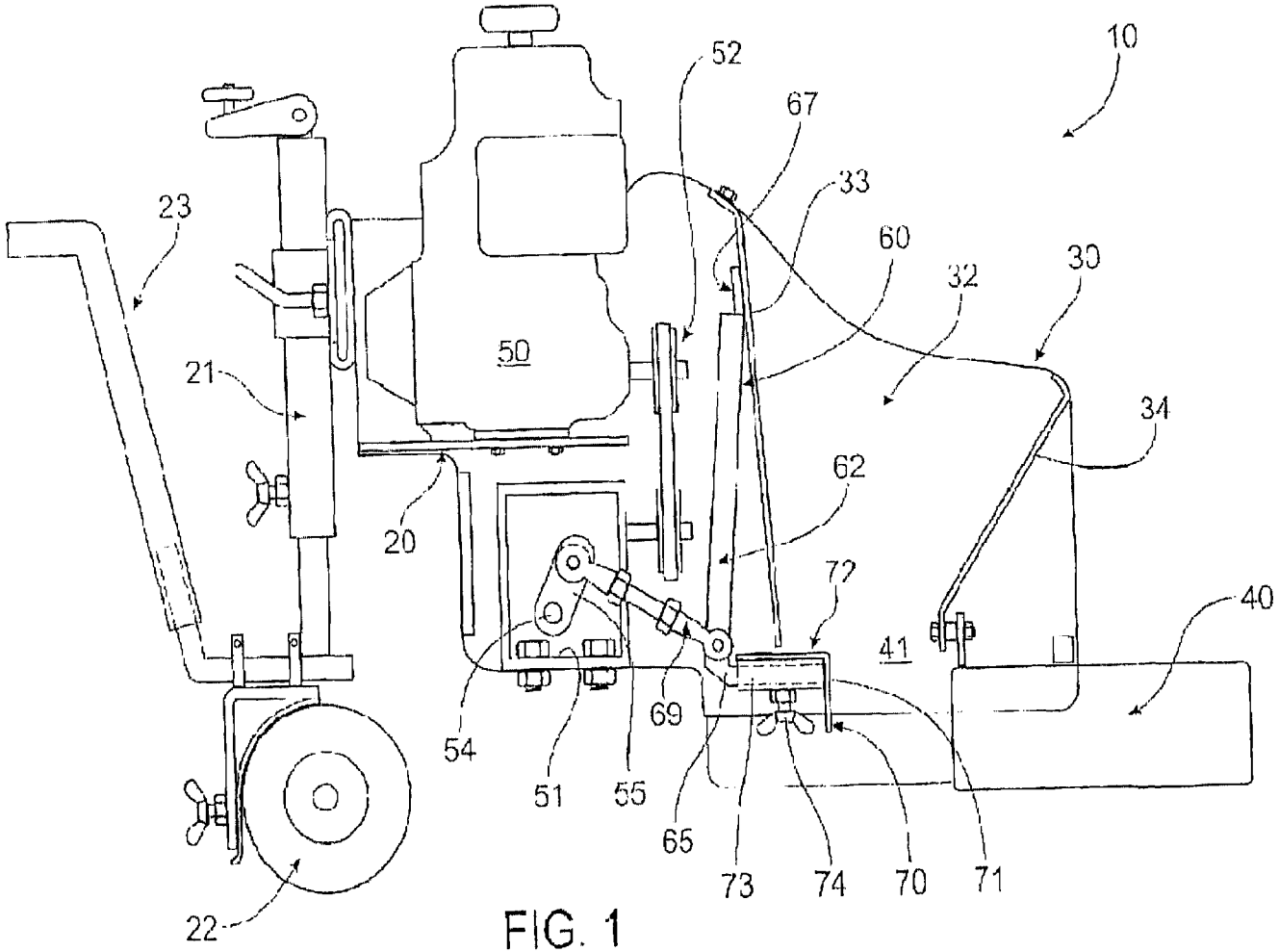
FIG. 1 is a part-sectional side view of the machine.
Figure 2:
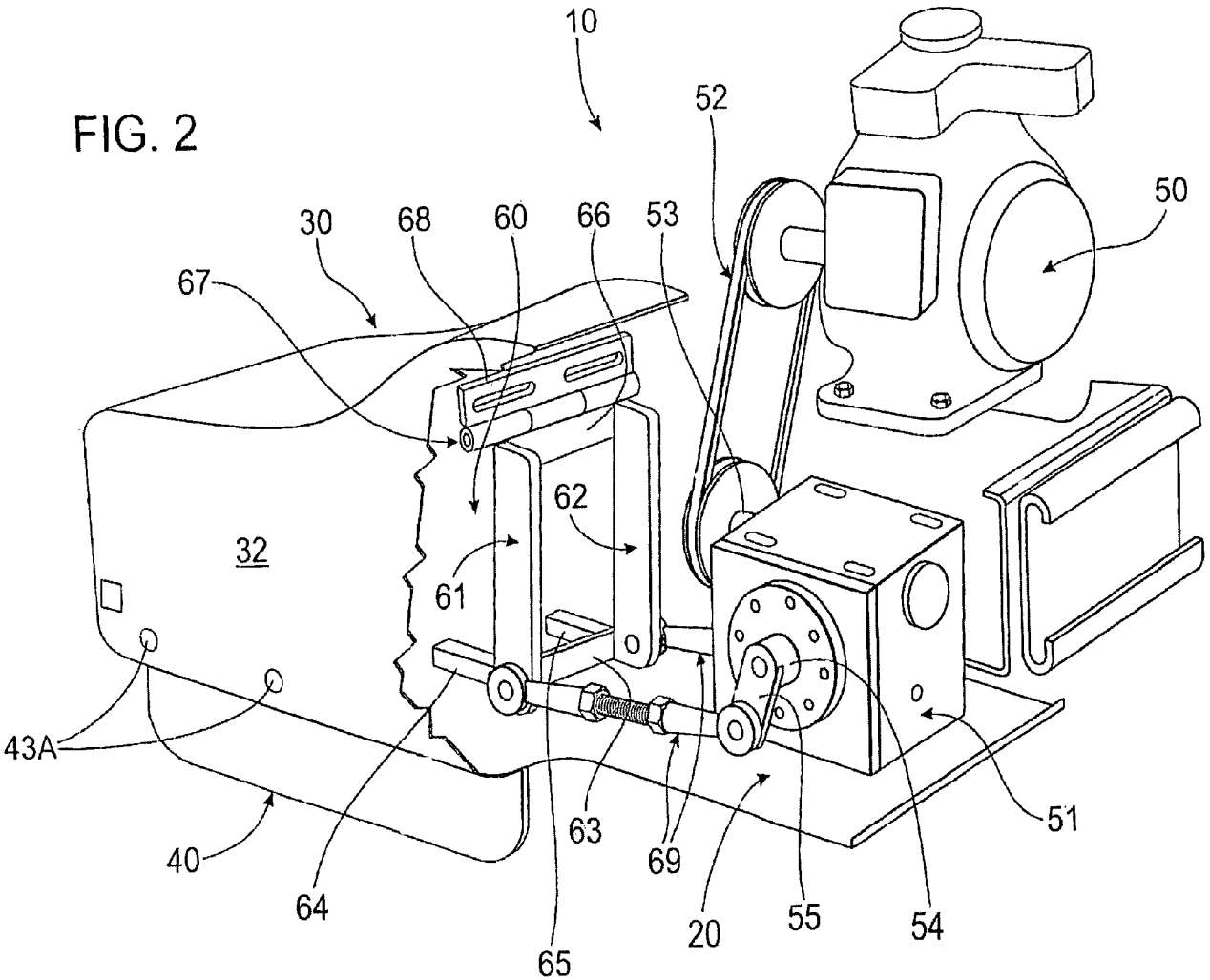
FIG. 2 is a schematic perspective view of the drive mechanism.

The machine 10 (FIGS. 1 and 2) has a main frame 20 supported by a pair of independently height-adjustable wheels 22, having respective hand-adjustable mechanical jacks 21, mounted on the main frame, the wheels 22 being interconnected to a steering tiller 23 by a steering linkage (not shown).

A hopper 30 has side plates 31, 32 connected to the main frame 20, the hopper 30 further including inclined front and rear walls 33, 34, where the outlet of the hopper is provided above the mouth 41 of the mold 40. The lower ends of the hopper side walls 31, 32 form side walls 42, 43 for the mold 40.

An internal combustion engine 50 is mounted on the main frame 20 and is operably connected to a gearbox 51 by a belt-and-pulley combination 52 which drives the input shaft 53 of the gearbox 51.

The gearbox 50 has a pair of diametrically opposed output shafts 54, each output shaft 54 being provided with a crank arm 55.

The pusher means 60 has a pair of pendulum arms 61, 62 interconnected at their lower ends by a cross-member 63 from which projects forwardly a pair of (e.g., RHS) carrier arms 64, 65.

The upper ends of the pendulum arms 61, 62 are interconnected by one leaf 66 of a hinge assembly 67, which has the second leaf 68 welded or otherwise fixed to the front wall 33 of the hopper 30.

The pusher plate 70 has a pusher face 71 which extends substantially the full width of the mold 40 and has an integral top plate 72, which, as the pusher plate 70 is moved with a reciprocating motion, selectively opens and at least partially closes the mouth 41 of the mold 40 to control the flow of concrete from the hopper 30 to the mold 40.

A pair of adjustable links 69 interconnect the respective crank arms 55 to the pendulum arms 61, 62, the links 69 being adjustable to (a) ensure the reciprocating movement of both pendulum arms 61, 62 is identical and (b) adjust the relative position of the pusher plate 70 to the mouth 41 of the mold to control the volume of concrete passing through the mouth 41 on each reciprocating stroke of the pusher plate 70.

By interconnecting both pendulum arms 61, 62 to respective crank arms 55 driven by the gearbox 51 (via the links 69), an even driving force is applied to the pusher plate 70 as it undergoes its reciprocal movement.

A pair of tubular (preferably rectangular) sockets 73 are provided on the underside of the top plate 72, releasably engageable with the carrier arms 64, 65 and releasably secured thereto by locking studs 74.

The provision of the sockets 73 on the pusher plate 70, complementary with the carrier arms 64, 65 on the pendulum arms 61, 62 enables the pusher plate 70 to be easily fitted to, or removed from, the machine 10, e.g., when concrete moldings of different widths are to be produced.

Figure 3:
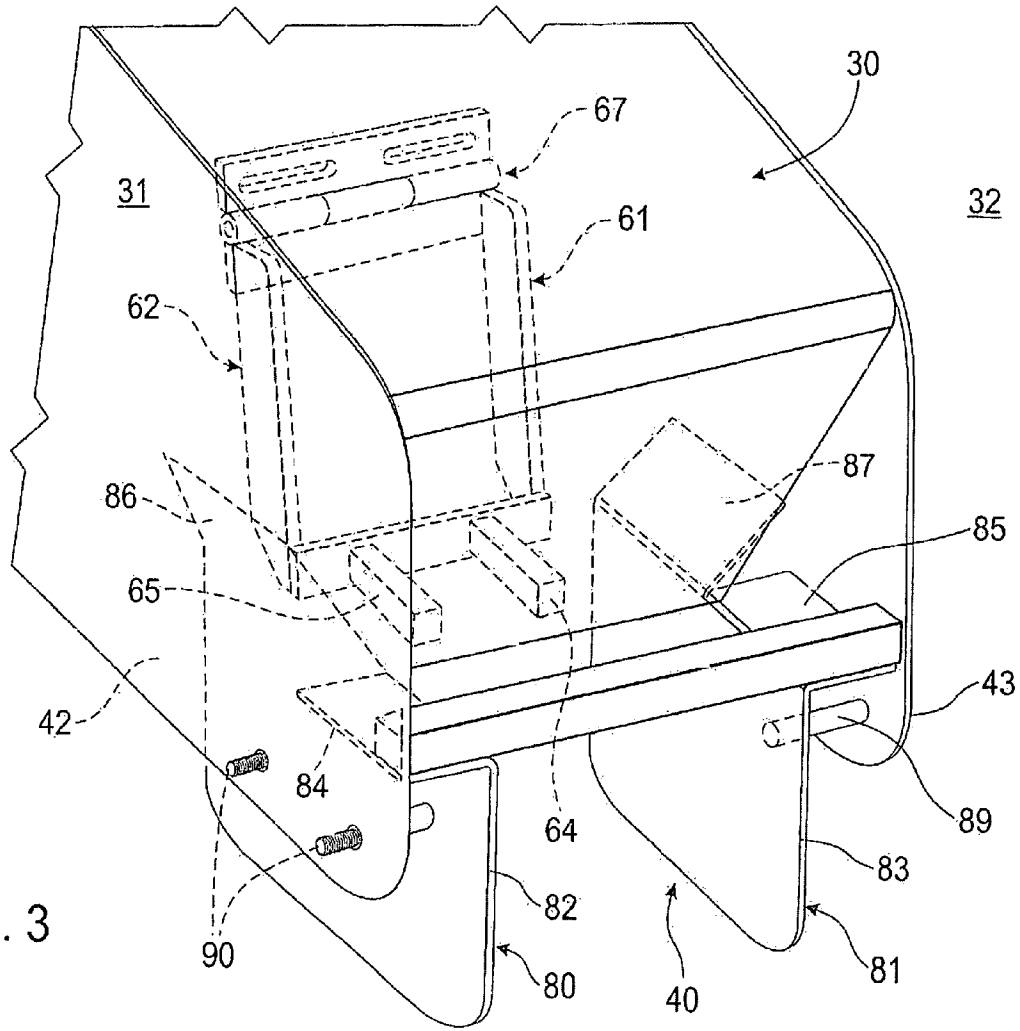
FIG. 3 is a perspective view of the rear of the machine, parts being shown in dashed lines for clarity.
Figure 4:
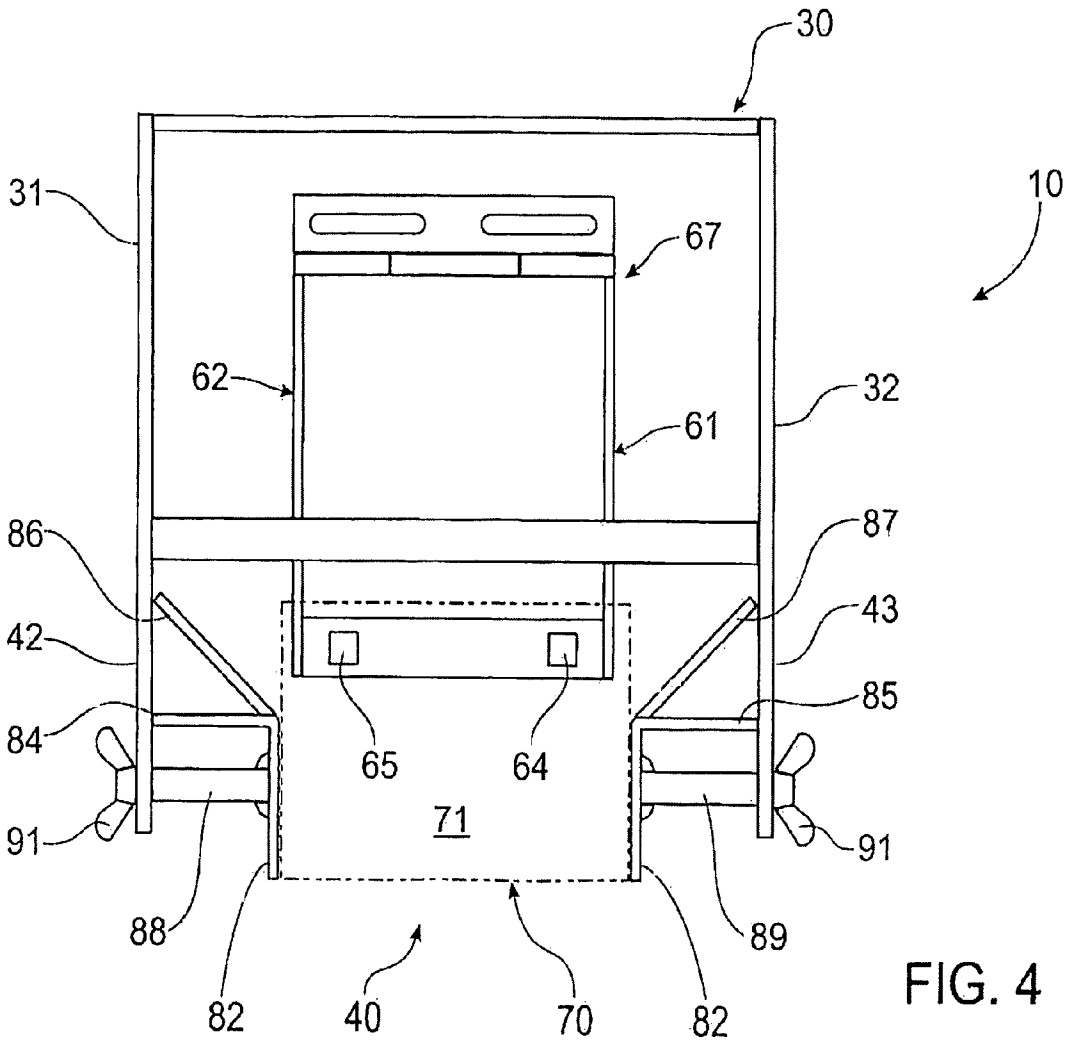
FIG. 4 is a rear elevation view of the machine in one embodiment.
Figure 5:
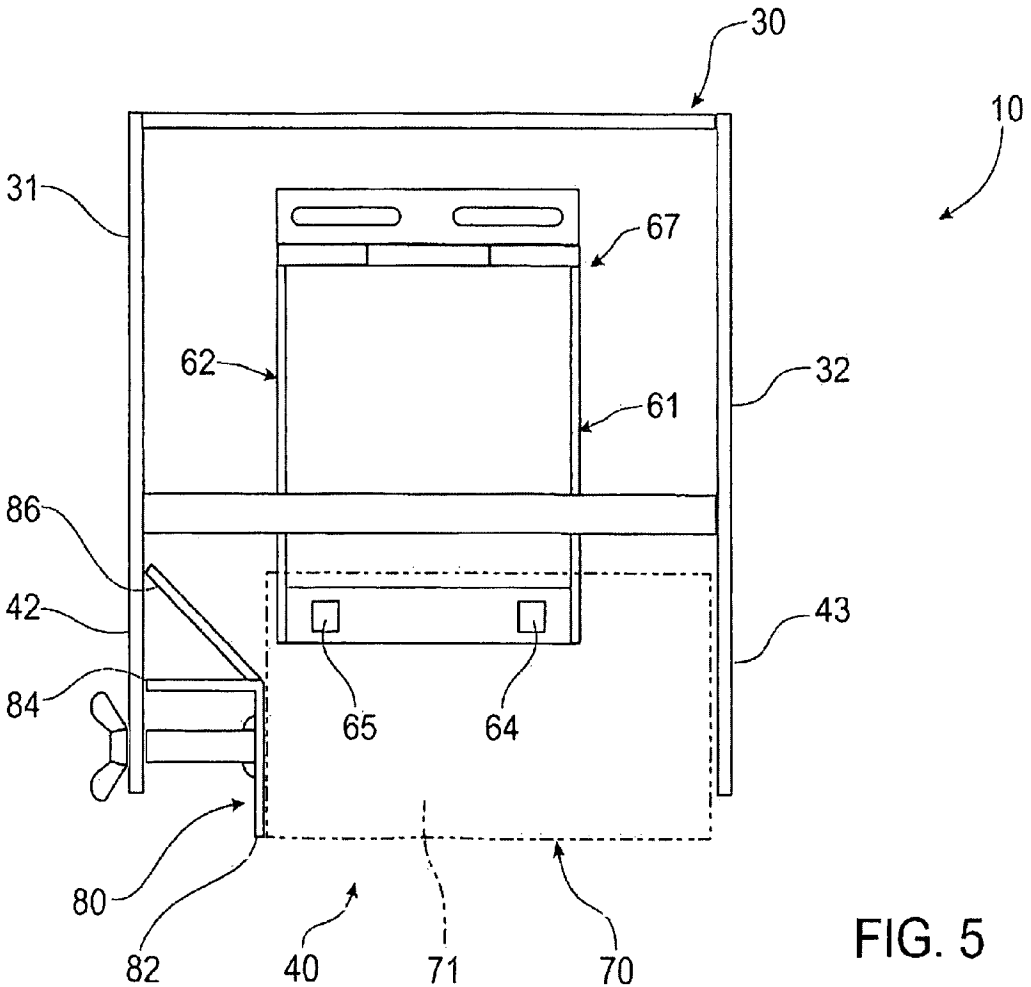
FIG. 5 is a similar view in a second embodiment.

Referring now to FIGS. 3 to 5, the machine 10 may be set to extrude concrete moldings of a maximum width of, e.g., 300 mm, being the distance between the side plates 42, 43 of the mold 40.

For a reduced width of, e.g., 200 mm, a pair of substantially L-shaped tunnel plates 80, 81 are provided within the mold 40 where each tunnel plate 80, 81 has a side wall 82, 83, a substantially horizontal top wall 84, 85 and an inclined wall 86, 87, the inclined walls 86, 87 being received within the mouth 41 of the mold 40 and engaging the respective side walls 31, 32 of the hopper to direct the concrete to the reduced width mold 40 between the tunnel plates 80, 81.

Preferably, each tunnel plate 80, 81 has a pair of spigots 88, 89, with screw threaded studs 90, which extend through aligned holes 43A in the side plates 42, 43 of the hopper 40, and which are secured by wing nuts 91. As shown in FIG. 5, only tunnel plate 80 may be provided to enable the machine 10 to extrude concrete moldings of an intermediate width, e.g., 250 mm.

It will be readily apparent to one of skill in the art that a number of the tunnel plates 80, 81, of different widths may be provided which effectively reduce the width of the mold 40 by, e.g., 5/10/25/50 mm increments.

When a concrete molding of reduced width is to be extruded, e.g., by fitment of one or two tunnel plates 80, 81, the pusher plate 70 is removed and a complementary pusher plate 70, where the pusher plate face 71 substantially extends across the reduced width of the mold 40, is substituted on the pusher means 60.

As shown in FIG. 5, where only one tunnel plate 80 is used, the resistance applied to the pusher plate 70 will be uneven as the center line of the mold 40 is offset relative to the center line of the pusher plate 70. However, the provision of the two driving links 69, connecting the pendulum arms 61, 62 to the crank arms 55 on the gearbox 51, will ensure an evenly applied driving force to the pusher plate 70, resisting any tendency of the driving means 60 to twist and cause the pusher plate 70 to jam against adjacent side plates or tunnel plate(s) of the mold 40.

It will be readily apparent to one of skill in the art that the present invention provides a machine that is capable of extruding concrete moldings of greater width than those disclosed in the machine disclosed in AU-B-16800/88; and also enables simple and quick changes in the width of the extruded concrete moldings by the provision of the tunnel plates 80, 81 and complementary pusher plates 70, the latter being easily detachable from, or fitted to, the pusher means 60 via the provision of the carrier arms 64, 65, and sockets 73 on the top plates 72.

Various changes and modifications may be made to the embodiments described and illustrated without departing from the present invention.

What is claimed is:

1. A concrete molding machine movable in an extrusion direction and comprising:

a hopper for concrete connected to an entrance of a mold;

at least one tunnel plate detachably mountable within the mold for reducing the width thereof to a reduced width, the at least one tunnel plate being substantially L-shaped with a side wall and a substantially horizontal top wall extending away from the reduced width of the mold;

a pusher for forcing concrete through the mold, the pusher including mounting supports and a pusher plate with a pusher face extending substantially across the width of the mold, the pusher plate having at least one mounting device releasably mounted on the mounting supports of the pusher means, the pusher plate detachable from the pusher and substitutable by a second pusher plate having a pusher face extending substantially across the reduced width of the mold;

a support for the pusher plate enabling reciprocating movement of the pusher plate between a first position allowing concrete to pass from the hopper to the mold and a second position for extruding concrete from the mold; and a drive mechanism connected to the pusher to generate the reciprocating movement of the pusher plate.

2. The machine recited in claim 1, wherein:

the hopper further has a pair of spaced-apart side plates;

the at least one tunnel plate comprises a pair of tunnel plates, each detachably mountable to one of the side plates of the mold;

the pusher plate comprises a plurality of pusher plates, a pusher plate provided for each effective reduction in the width of the mold effectible by the tunnel plates;

the support has a pair of forwardly projecting carrier arms extending forward of the pusher plate; and the pusher has a top plate formed integrally with the pusher plate, the top plate having at least two sockets, each detachably engageable with a complementary carrier arm on the support means.

3. The machine recited in claim 1, further comprising:

a frame for supporting the hopper;

the support means for the pusher plate including a pair of pendulum arms pivotally mounted on one of the hopper and the frame; and the drive mechanism connected to the pusher operably connected to the pair of pendulum arms.

4. The concrete molding machine recited in claim 3, further comprising a cross-member affixed in interconnecting relation to the pair of pendulum arms adjacent the pusher.

5. The machine recited in claim 3, further comprising:

a pair of length-adjustable driving links for enabling an adjustment of the reciprocating movement of the pusher plate, each connected to a respective one of the pair of pendulum arms distal from the one of the hopper and the frame; and wherein the drive mechanism further comprises:

a gearbox drivable by a power source, the gearbox having a pair of output shafts; and a pair of crank throws, each affixed in connecting relation to a respective one of the output shafts and the driving links.

6. The machine recited in claim 1, wherein the at least one tunnel plate further includes an inclined wall received within a mouth of the mold and engaging a respective side wall of the hopper.

* * * * *